United States Patent [19]

Baker

[11] 4,222,572

[45] Sep. 16, 1980

[54] CARD DECK AND GAME BOARD

[76] Inventor: Louis J. Baker, 4601 W. 4th St., Reno, Nev. 89503

[21] Appl. No.: 966,884

[22] Filed: Dec. 6, 1978

[51] Int. Cl.[3] ..... A63F 1/02; A63F 3/00

[52] U.S. Cl. ..... 273/306; 273/274

[58] Field of Search ..... 35/69; 273/303, 304, 273/305, 306, 274; D21/42, 43

[56] References Cited

U.S. PATENT DOCUMENTS

| | | | |
|---|---|---|---|
| 1,011,610 | 12/1911 | Gaskill | 273/305 |
| 1,315,907 | 9/1919 | Burlew | 273/303 |
| 1,738,902 | 12/1929 | Howard | 273/306 X |
| 3,998,462 | 12/1976 | Goott | 273/274 X |

*Primary Examiner*—Harland S. Skogquist

*Attorney, Agent, or Firm*—Seiler & Quirk

[57] ABSTRACT

A card deck comprises high and low red and black cards, high cards having an indicia thereon and low cards lacking such indicia, and high cards of a third color, preferably gold or silver. In a preferred deck, there are 16 low red cards, 16 low black cards, 8 high red cards, 8 high black cards, and 4 high gold cards. The invention includes game board playing surface for selecting or guessing different cards or hands to be dealt by a dealer.

18 Claims, 12 Drawing Figures

CARD DECK AND GAME BOARD

BACKGROUND OF THE INVENTION

Card games, using a standard deck of cards, have been played in combination with game boards on which there are shown different areas designating different and various combinations of cards which may come up, or be shown, in a dealt hand, or on individual cards. By way of example, is U.S. Pat. No. 3,998,462 illustrating a game board playing surface on which are located a series of possible combinations of cards which may be dealt by a dealer for the game, and in which designated areas of the board, players may place chips to indicate their guesses at which cards the dealer may deal from the playing card deck. Such a game, as well as the various combinations of cards which may be shown or come up in a dealt hand, are based on conventional poker hands. Although the various poker combinations are well known to some people, since a conventional deck of cards includes those from 2's or deuces through aces, because of all the different numerical card designations, including the face cards, the game is somewhat complex for the novice.

SUMMARY OF THE INVENTION

The card deck of the present game is designed to eliminate cards having different numerical designations as in a conventional playing card deck, and utilizes only high and low card designations, combined with a plurality of colors, preferably red and black, and gold and/or silver. In the card deck of the invention, the high cards are designated by an indicia, preferably a crown, or the like, signifying a high card designation, which is located on the face of the card for immediate observation. The low cards are preferably designated simply by the lack of the high card indicia or designation. The number of the cards used in any particular game may vary, but normally the deck contains 52 cards, 32 low cards, half being black, and half being red, and 20 high cards.

A number of games may be played with such a deck as will be pointed out hereinafter, with the play being interesting and exciting, without the requirement of sorting and keeping track of a number of different low and high card denominations as are found in conventional playing card decks. Moreover, games of chance may be played utilizing different game board playing surfaces having a plurality of areas for designating different combinations of the cards, or different individual cards, which are dealt by a dealer. Such a board is especially useful where a plurality of players desire to place chips, or make bets, to attempt to guess which individual cards will be turned up by the dealer or combinations of such cards in a hand to be dealt. A description of such a board as well as the play in such games will be disclosed hereinafter.

DETAILED DESCRIPTION OF THE INVENTION

Figure 1:
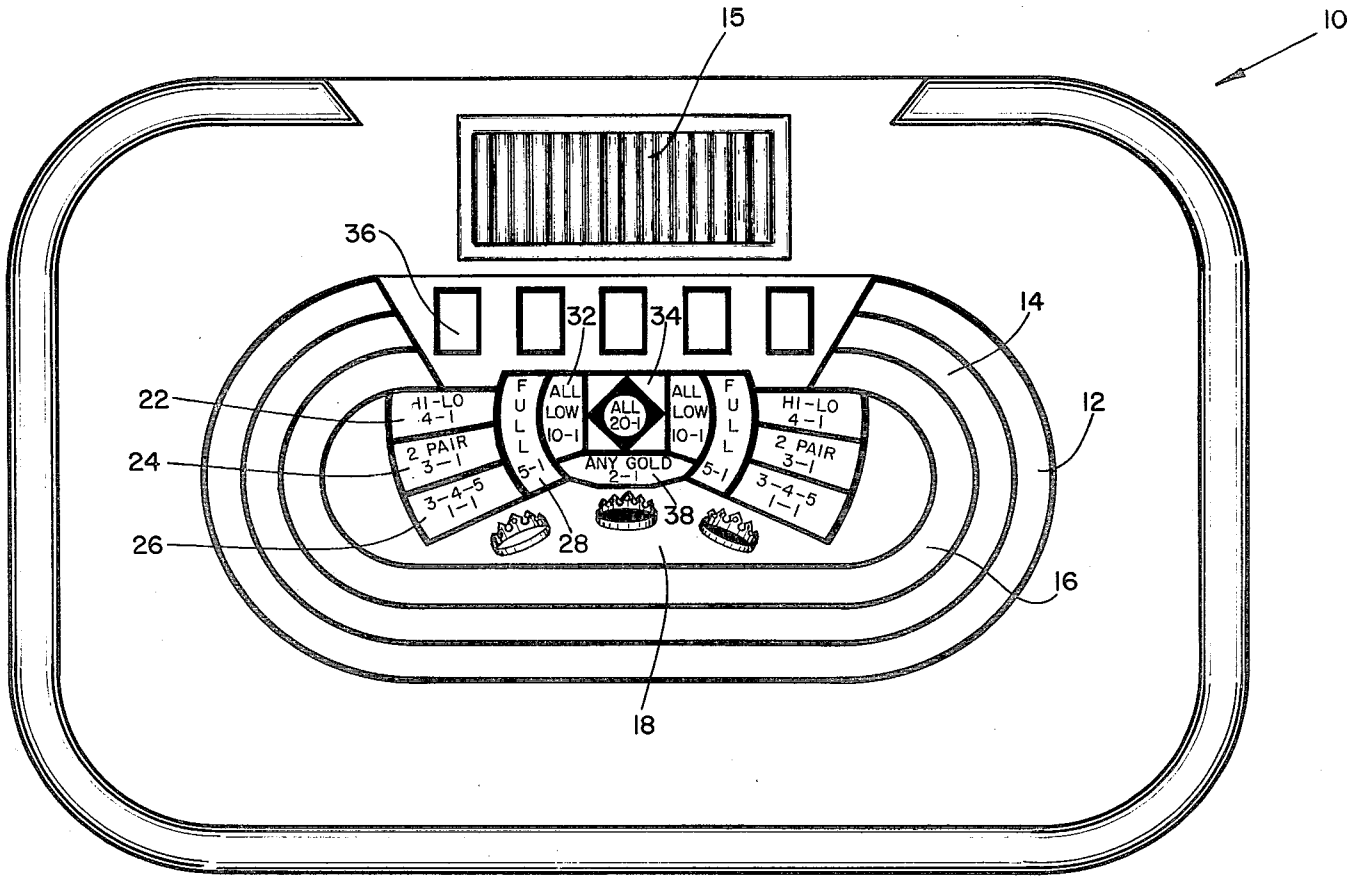
FIG. 1 is an illustration showing a first game board playing surface on which five cards are dealt for a single hand, and showing various areas designating different combinations of cards which may be dealt in a hand.

The card deck of the invention comprises a plurality of cards designated high cards and low cards. The cards do not have numerical values on their faces, but instead are differentiated by different colors on the cards, the preferred deck having cards designated red and black, and with certain other cards designated with gold, silver, or some other color other than red and black. The high cards are indicated by an indicia designating those cards as high cards. Any suitable indicia or marking may be used, that shown in the drawings herewith being a crown. However, the crown designation is not critical, and any other high card designation may be used so long as it distinguishes the high cards from the low cards. Such high cards are illustrated in FIGS. 3, 4 and 5.

Figure 3:
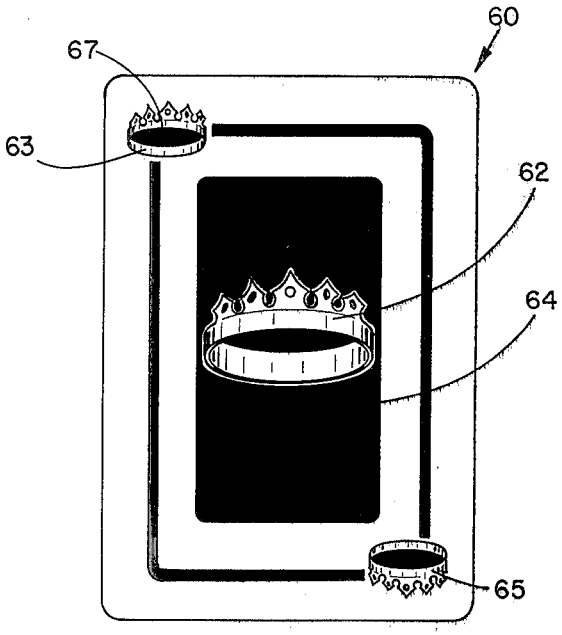
FIGS. 3–8 illustrate different cards which comprise a card deck of the present invention.

Observing particularly FIG. 3, the face of card 60 is shown having a center area 64 of a black color so as to distinguish that card as a black card. Although the shape of the color designation area shown is rectangular, any other desirable shape may be used such as a circle, square, or the like, so long as a specific color designation of that card may be readily observed by a player. The high card designation indicia 62, in the form of a crown, is preferably located within the color designation area 64. However, the high card designation indicia may be located elsewhere, again so long as it is clearly visible, even at a quick glance by a player or observer. Conveniently, small corner high card designation 63 and 65 are located in the upper left and lower right hand corners of the card face so that when the card is otherwise partially covered, as a player often fans his hand of cards, the high card designation is readily obervable. In addition, these high card designations or indicia may also include a color designation 67, that shown being across the high card indicia, although it may encircle the indicia, or the indicia itself may be so marked by that color. Having such a color designation also associated with the high card indicia on the corners of the cards will also enable the player to readily observe the fact that the card is not only a high card, but also the color of designation of that high card, even though the card is substantially covered, except for the observable corner of the card. Although these high card indicia 63 and 65 are shown in only two corners of the face of the card, they may be shown on any one or plurality of the corners, as desired.

Figure 4:
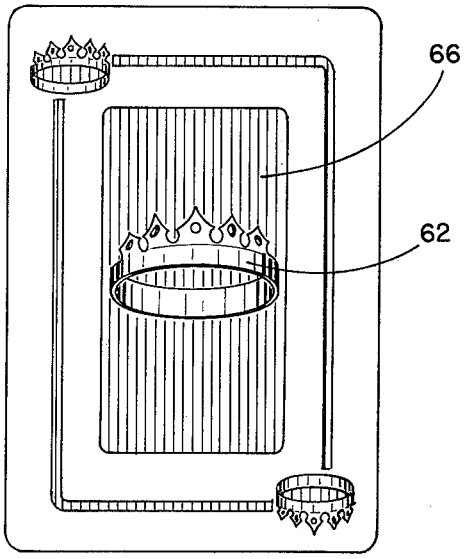
Figure 5:
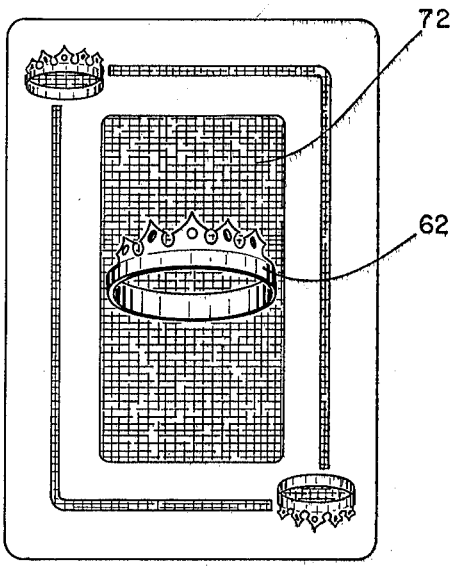

FIGS. 4 and 5 illustrate the two other high card designations of the preferred embodiment, FIG. 4 illustrating the high red card, in which the color designation 66 and high card indicia 62 are shown on the face of the card. In the preferred deck of the invention, a third high card color is used, gold or silver being preferred, with FIG. 5 showing a gold color designation area 72 in which high card indicia 62 is also present. Thus, the three different color designated high cards have the same high card indicia, but simply different colors in the color area of the card.

Figure 6:
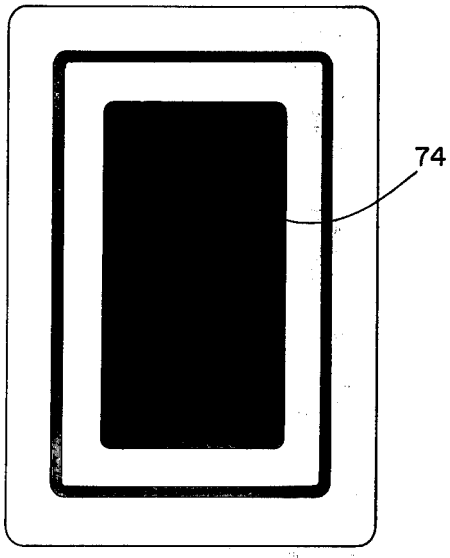
Figure 7:
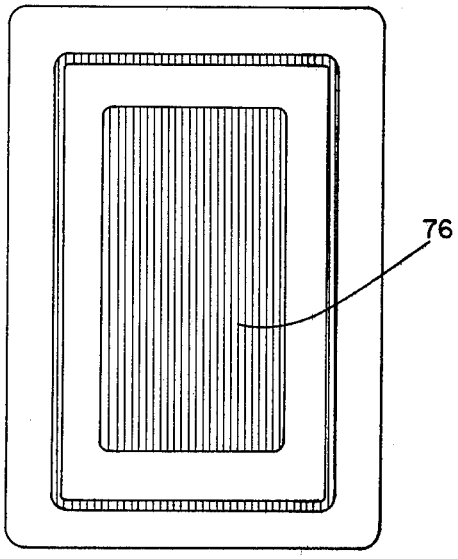

FIGS. 6 and 7 illustrate the preferred low cards of the card deck of the invention. Preferably, those cards have a low designation simply by lacking the high card designation or indicia shown on the high cards. Accordingly, low cards shown do not have the crowns or other high card indicia on the card face, but only the respective black card color designation area 74 and red area 76 as shown. Again, these color designations may be any shape as desired, and need not even be a solid color area on the face of the card as shown, but instead, a design of lines, dots, or the like on the card surface. Of course, such a color designation area is preferably uniform for all cards of a deck, high or low. Although the low card designation may simply be the absence of the high card designation, as previously stated, it may also be a specific low card indicia. The placement of such a designation may also be at any desired location on the card face, at the corners, in the center, or wherever else is desired. However, for simplicity and ease of observation for indicating such a low card, a preferred low card will simply have the color of that card in a designated card face area, with no other specific designation thereon. For added esthetics, other lines or borders, preferably of the same card color designation, in a manner shown, may be used.

Figure 8:
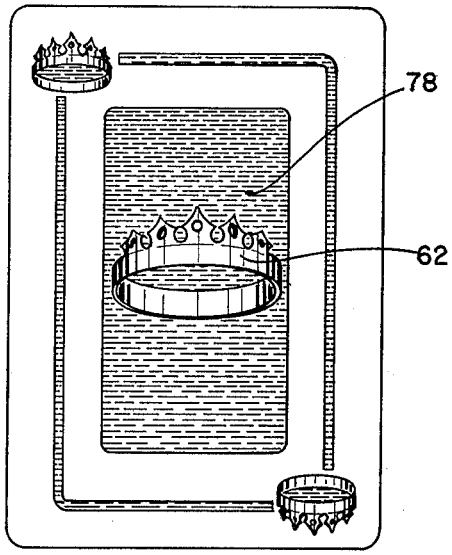

FIG. 8 illustrates an optional joker card, that shown having a silver and high card designation. In other words, the joker not only includes high card indicia 62, but yet a fourth color 78, silver, so as to further distinguish it from the other high cards. In games that may be played with the deck, the fourth color card is quite optional, as jokers are in conventional playing card decks. Moreover, it need not have a high card designation, but may instead be a low card designated joker. In that case, according to the preferred embodiment, such a low card joker would have a fourth color designation, but no high card indicia thereon. As for the specific joker color, with black and red being used for the low card colors, since those colors are conventional playing card colors, and well accepted, and with the high cards being red, black, and the third high card color being gold, the jokers may conveniently be silver. However, other than red and black, which are the preferred colors for both the low and high cards of first and second colors, the third and fourth high card colors, i.e., the colors for the cards of FIGS. 5 and 8, may be any other desired colors, silver and gold being simply examples of other easily distinguishable colors from red and black.

In FIGS. 9–12, there are shown other high card embodiments, in which the high cards of each color are further distinguished as gold and silver. Thus, in a normal deck of 52 regular cards, not counting jokers, of the 8 high black cards, 4 will be gold and 4 silver, the gold usually and conveniently being of higher value. Similarly, of the 8 high red cards, 4 will be gold and 4 silver. Such further high card color designations are conveniently shown or associated with the high card indicia.

Figure 9:
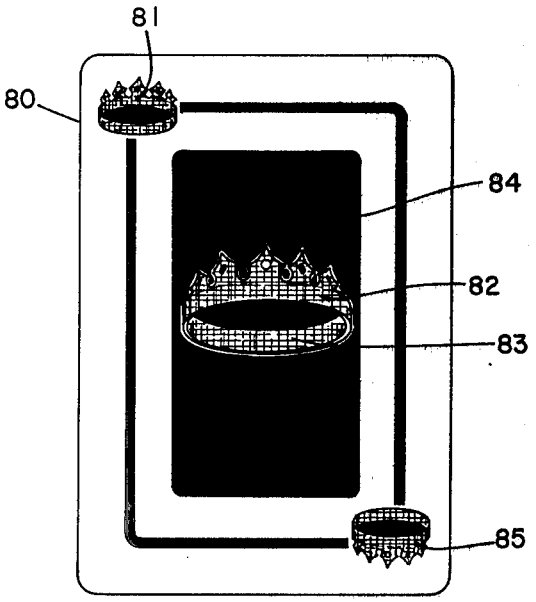
FIGS. 9–12 illustrate another embodiment of high cards.
Figure 10:
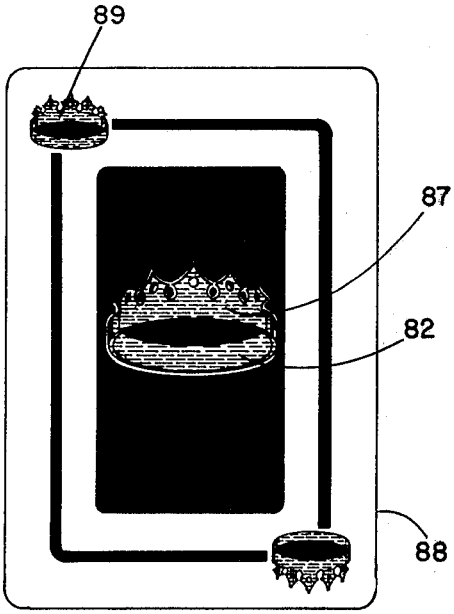
Figure 11:
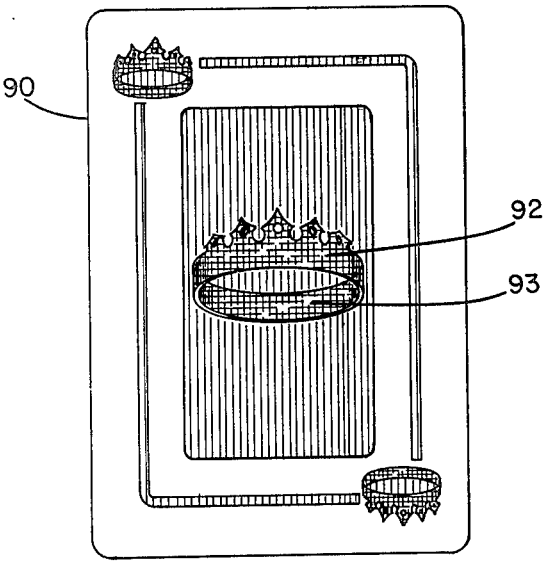
Figure 12:
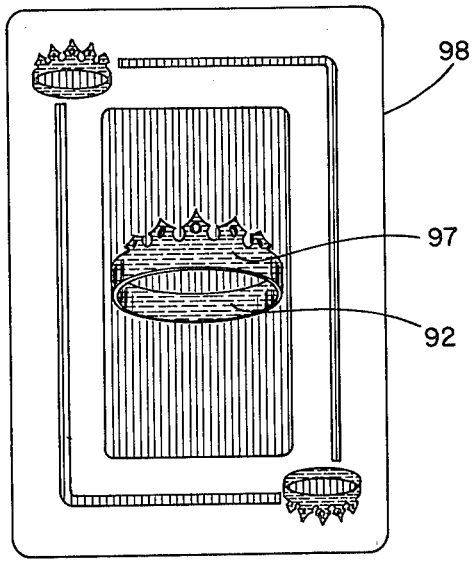

In the high black card 80 of FIG. 9, in the black color designation area 84 is high card indicia 82, having a gold colored body 83. The small corner high card designations 81 and 85 are also gold. In FIG. 10, black high card 88, has a high card indicia 82 having a silver colored body 87, as are the corner high card designation 89. In FIGS. 11 and 12 the high red cards are further designated gold and silver, respectively. High red card 90 has a high card indicia 92 with a gold colored body 93, while card 98 high card indicia 92 is silver. The further distinction of high cards is especially convenient for poker, pinochle and rummy type games, some played with double decks. The use of equal numbers of gold and silver high cards of each color is preferred.

In the preferred card deck of the invention, the number of low red and low black cards are equal, and the number of red and black high cards are also equal, but different from the number of low cards. More specifically, is preferred that the number of low cards be double the number of red and black high cards, so that there will be twice as many black low cards as black high cards, and twice as many red low cards as red high cards. The number of third color high cards, for example, gold cards as shown in FIG. 5, is preferably half the number of either of the high red or black high cards. Thus, a specific and preferred card deck of 52 cards will comprise 16 low black cards, 16 low red cards, 8 high black cards, 8 high red cards, and 4 high gold cards. Where jokers are desired, these will be a fourth color card, preferably designated a high card, and there may be one or two, two jokers commonly being provided with a deck of 52 other cards. A preferred deck of 52 cards is most convenient since the size of the deck is the same as the size of a conventional playing card deck.

As examples of the games which can be played with a deck of the invention, as previously described, a card game which is most popular with conventional playing card decks is "21", also known as blackjack. The major difference between that popular game played with a conventional deck as compared with the present deck is that the value of the cards would be somewhat different. In such a game, each low card has a value of 5, red and black high cards values of 10, thus corresponding to the face cards of a conventional deck, and the four gold or third color high cards a value of 1 or 11, corresponding to aces of a conventional deck. Otherwise, the game is played substantially like "21", the object of the game, of course, to achieve a hand of exactly 21, without going over that number, or otherwise coming closer to 21 than the dealer. The game may be played whereby a dealer must stand with a total hand value of 17, and players can double their bets if the first two cards have a value of 6 or 10, and matched pairs may even be split.

Other games that may be played with the card deck of the invention include those which are similar to "hearts" and "pitch", two popular conventional card deck games. An example of one of the games, referred to as "plus-minus", has an object to win as many black cards, and get rid of as many red cards, as possible. The gold or third color cards are neutral. The above described 52 card deck is used, black cards being plus point cards and red cards being minus point cards. Three to six players may play, and 6 cards are dealt to each player. The first player to the left of the dealer leads off, and may keep the lead himself, or attempt to pass the lead to someone else. Players must follow the color of the card lead, and take the trick with a high card over a low card, first high card taking the trick, or can play low, i.e., duck the trick if they wish. A red card may be played on a black card if the player is out of black cards, and does not take the lead or the trick. The first red card lead takes the trick, a high red card taking a low red. If out of red or gold cards, a player must place a black card on a red lead, and if it is the highest or first low black card shown in the hand, that person takes the lead. At the end of each hand, the player having the most red cards pays each of the other players so much per point, less the number of black cards collected. Thus, the player with the most red cards in his hand must pay each of the other players a predetermined amount equal to the number of red cards, minus the number of black cards, collected from the hand.

Another game which may be played is called "Force 1", using 49 cards of the deck, 24 red, 24 black, and one gold. There may be 3∝5 players, each player being dealt six cards. The play is started by the players bidding, bidding beginning at seven and going to ten, the highest bidder selecting trump, and each player bidding only once, or passing. If no one bids, a bid of six is forced on the dealer, the bidding starting at the first player to the dealer's left. The object of the game is to establish either red or black as trump, and win as many trump cards as possible by taking tricks. Trump is established by the first card led, or otherwise announced by the player taking the bid prior to playing the first card. The gold card is counted also as a trump card, and it is the highest card and will win any trick. High cards win the trick, and the first high card led wins that trick, except for the gold card, which will take any trick. When a gold card is led, a player with a high card of trump must play that card. If the player leads low, then any subsequent player who leads the first high card of that color would take the trick. The object of the game is to take as many trump cards as possible, and any player who does not obtain any trump cards during play must pay all the other players according to how many trump cards or points those players have in their hands. Each player pays the winning bidder an amount equal to the number of points in that bidder's trump cards collected by tricks.

Figure 2:
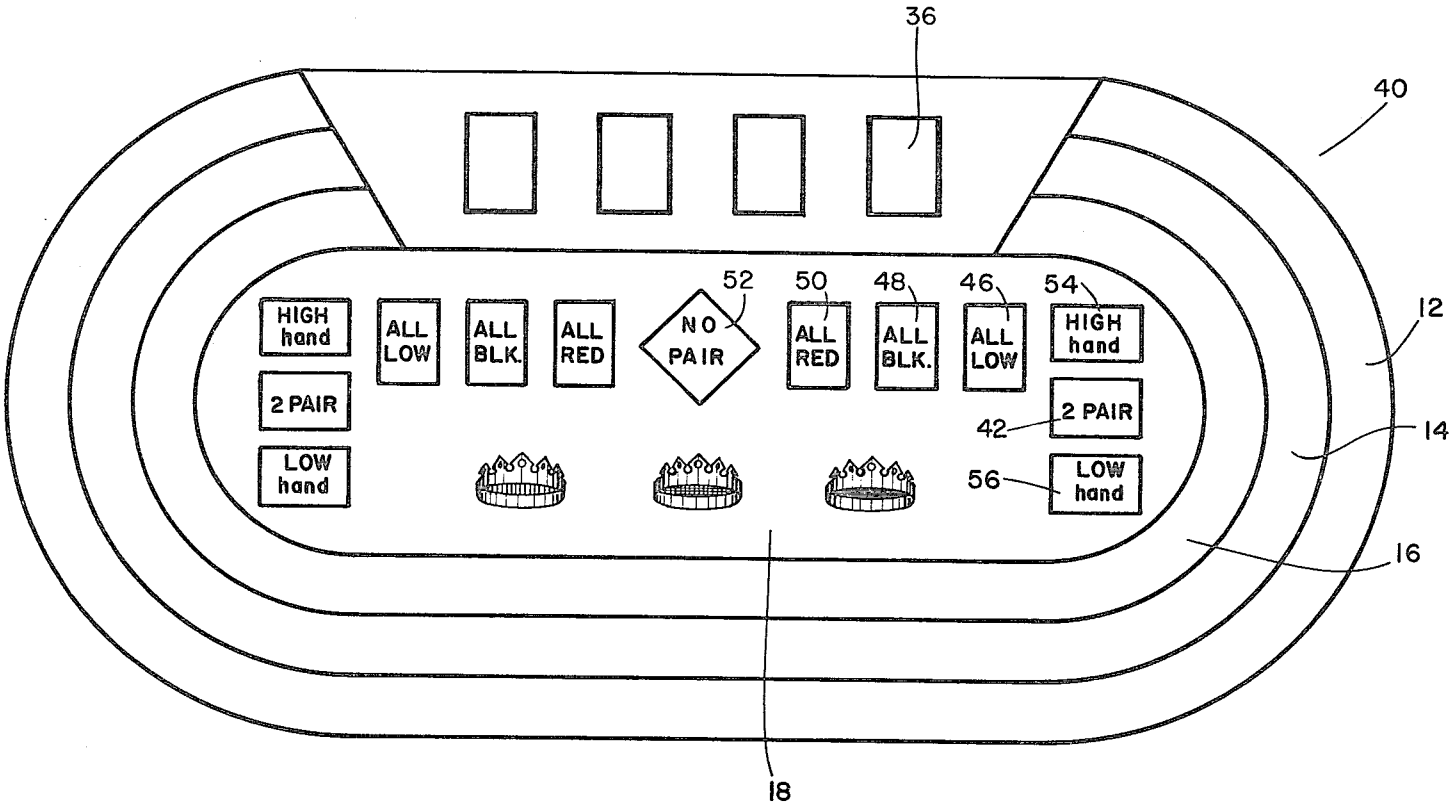
FIG. 2 shows a game board playing surface for a game in which four cards are dealt for a hand, and on which surface areas designating different combinations of cards in a hand are shown.

In FIGS. 1 and 2 there are shown game board layouts played with a card deck according to the invention, particularly adapted to casino, or similar play where a dealer deals a hand, each card of the hand being turned up consecutively, and with one or more players, located around the game board, placing chips, or bets, on any one of a selected number of areas on the game board designating different cards which may be turned up by the dealer, or different hands of cards.

Observing first FIG. 1, there is shown a game board 10, used for a five card hand game, wherein a dealer turns up five cards, individually and consecutively, and places them in sequence on the respective card areas 36. The dealer normally stands behind the chip storage area 15, with the players then sitting or standing around the remaining periphery of the game board playing surface. Each of the players will have 1 or more chips, of the same or different demoninations, which they may place on the game board playing surface in the different areas to designate their bets or choices as to which card the dealer will turn up next, or they may place proposition bets for a combination of cards which they believe or guess the dealer will turn up in the next hand of five cards. In the playing surface shown, there are designated three areas 12, 14 and 16 for black, red and gold cards respectively. These three colors correspond to the black, red, and gold cards in the previously described 52 card deck. The players may bet, or place chips, in one or more of these designated card color areas to indicate their selection or guess of the color of the next card the dealer will turn up. Accordingly, if a player wishes to bet, or guess that the next card the dealer will turn up is black, he will place one or more chips in area 12 of the playing surface. Similarly, a player may place chips in red designated area 14 or gold area 16, as desired. Because of the relative number of red, black and third color or gold cards in the deck, if the dealer turns up the next card of a color which corresponds to a color selected or guessed by a player, so designated by the player having one or more chips in that color area, the dealer will pay the player 1:1 (even) for red or black cards, and 10:1 if a gold card is selected and is turned up.

A field bet or card selection area 18 is designated on the playing surface and contains three high card designations, one of black, one of red, and one of gold, as shown. This field area is also an area where a player may place chips to select the next card guessed that the dealer will turn up. If the next card the dealer turns up is a high card, the player wins a field bet, any black or red high card paying off 1:1, or a gold high card paying 3:1.

The playing surface also includes a proposition bet or hand selection area having a different number of individual areas for selecting different hands. Those proposition areas shown account for all of the preferred proposition designated areas. Area or space 22, designated "high-low" is for selecting or guessing that the hand of five cards to be dealt by the dealer will have only a high card pair or a low card pair in it. A high card pair is any two high cards of the same color, and a low card pair is a pair of low cards of the same color. A third color high card or gold high card is wild, and good for completing either high or low pairs to form the highest possible hand. The designated payoff for selection of such a pair is 4:1, as indicated in the playing surface indicia.

The playing surface area 24 designated "2 pair" is for selecting a hand in which there will be 2 pairs of cards, both pair being low, or both pair being high, or one pair being high and one pair being low. Again, the gold high card is wild, and selection of such two pair may pay off 3:1 as indicated. Hand card selection 26 is for selecting a hand in which 3, 4 or 5 cards of a kind will be present. To pay off for such a hand, it must have only those cards, and a full house of three high cards and two low cards, or three low cards and two high cards, will lose. Again, the gold card is wild. The full house selection area 28 is for selecting a full house as previously described, and the payoff is shown as 5:1. Proposition bet area 32 is for selecting all of the 5 cards being low cards, and the "all" selection area 34, is for selecting all cards to be of the same color, high or low. That area may be further modified to designate a portion for selecting all red and all black cards in the hand. Area 38 is for selecting that at least one gold card will be exposed in the hand. If desired, when such a gold card appears, the player may elect to let the bet play again, and if another gold card is exposed, the pay-off is substantially increased. However, the player will then lose if another gold card does not appear.

Again, these areas of the playing surface 10 illustrated in the drawing are those preferred, and one or more may be deleted, as desired, or different combinations may be added as proposition bets or the like. Moreover, the position of those proposition bets or even single card selection areas may be varied, as desired, so long as they are conveniently located on a table for easy access by both the players who are placing their chips on the desired areas, and for retrieval or payoff of the chips by one or more dealers. Further, the odds may be varied as desired, those shown being preferred, especially for casino operations, where the payoff odds have been previously selected for realistic chance play and payoff, acceptable to most casino as well as player opportunities.

In FIG. 2 there is illustrated a game board playing surface 40 for dealing a four card hand, in which the cards are consecutively turned up and placed in the respective card areas 36. The game board shown utilizes the same card color designating areas 12, 14 and 16, in which a player may select or guess the color of the next card to be turned up by the dealer, as previously described. Similarly, the playing surface includes a field designated area 18 corresponding to that same area previously described in FIG. 1. The 52 card deck used for the game illustrated in FIG. 1 and so described is the same, but since a hand in this game comprises only 4 cards, the proposition bet or hand selection area has been changed somewhat. High hand selection area 54 is for selecting a high pair, two high pair, three of a kind or four of a kind in a hand. Low hand selection area 56 is for selecting a low pair, two low pair or no pairs. Two pair area 24 is for selecting a hand having one high and one low pair. Area 46 is for selecting a hand of all low cards, area 48 for all black cards, area 54 all red cards, and area 52 for selecting a hand of 4 cards in which there are no pairs. Again, the specific location of these different areas may be changed from that shown, and one or more of the areas may be left out, if desired, although those areas shown are preferred, since it will give the players a significant variety of bets to be placed, both for individual cards as well as proposition bets for selecting or guessing what the cards on the next hand will be. Thus, one or more selection areas of the five card game of FIG. 1 can be substituted for the four card game of FIG. 2, and vice versa. Moreover, in either the four or five card hand games, two decks may be separated, with all high gold cards being placed in one deck and all high silver cards in the other.

Other games to be played with the card deck of the invention will be evident to those skilled in the art, and all the cards need not be used for any single game, or decks may be combined for selecting different games to be played.

I claim:

1. A card deck comprising:

(a) a plurality of first cards, the face of each having a first color designation and a high card designation thereon, (b) a plurality of second cards, the face of each having a second color designation and a high card desigantion thereon, (c) a plurality of third cards, the face of each having a third color designation and a high card designation thereon, wherein said high card designation is the same on all of said first, second and third cards, (d) a plurality of fourth cards, the face of each having said first color designation and a low card designation thereon, and (e) a plurality of fifth cards, the face of each having said second color designation and a low card designation thereon, wherein said low card designation is the same on said fourth and fifth cards.

2. The card deck of claim 1 wherein said first color designation is black.

3. The card deck of claim 2 wherein said second color designation is red.

4. The card deck of claim 3 wherein said third color designation is gold.

5. The card deck of claims 1 or 3 wherein said high card designation is an indicia, and said low card designation is the absence of said indicia.

6. The card deck of claim 1 wherein the number of first and second cards are equal.

7. The card deck of claim 6 wherein the number of fourth and fifth cards are equal, but different from said number of first and second cards.

8. The card deck of claim 7 wherein the total number of fourth and fifth cards is twice the total number of first and second cards.

9. The card deck of claim 8 wherein the number of third cards is half the number of first cards.

10. The card deck of claim 1 wherein the cards have no numerical designation.

11. The card deck of claim 6 wherein the number of first and second cards is eight each.

12. The card deck of claims 7 or 11 wherein the number of fourth and fifth cards is sixteen each.

13. The card deck of claims 9 or 11 wherein the number of third cards is four.

14. The card deck of claim 1 including a plurality of sixth cards, the face of each having a fourth color.

15. The card deck of claim 9 including a plurality of sixth cards, the face of each having a fourth color, and wherein the number of sixth cards is half the number of third cards.

16. The card deck of claim 11 wherein four of the first and second cards have a gold high card designation, and four of the first and second cards have a silver high card designation.

17. The card deck of claim 16 wherein said first color designation is black, and said second color designation is red.

18. The card deck of claim 17 wherein the number of fourth and fifth cards is sixteen each, and the number of third cards is four.

* * * * *